United States Patent [19]

Nesbitt et al.

[11] 3,948,382

[45] Apr. 6, 1976

[54] DATA TERMINAL PRINTING ASSEMBLY

[75] Inventors: Dale D. Nesbitt, Berkeley; LeRoy O. Teagarden, Livermore, both of Calif.

[73] Assignee: The Singer Company, New York, N.Y.

[22] Filed: July 1, 1974

[21] Appl. No.: 484,892

Related U.S. Application Data

[63] Continuation of Ser. No. 327,515, Jan. 29, 1973, abandoned.

[52] U.S. Cl. ..... 197/165; 197/151; 197/171

[51] Int. Cl.[2] ..... B41J 33/44

[58] Field of Search ..... 197/1, 171, 165, 151, 153, 197/2, 154, 157, 158, 160, 162, 161, 167; 101/336

[56] References Cited

UNITED STATES PATENTS

| | | | |
|---|---|---|---|
| 2,902,136 | 9/1959 | Whippo | 197/165 |
| 3,460,665 | 8/1969 | Dodsworth et al. | 197/171 |
| 3,627,096 | 12/1971 | Finnegan | 197/1 R |
| 3,690,431 | 9/1972 | Howard | 197/1 R |
| 3,825,681 | 7/1974 | Cederberg et al. | 197/2 X |

*Primary Examiner*—Edgar S. Burr
*Assistant Examiner*—R. T. Rader
*Attorney, Agent, or Firm*—Edward L. Bell; Alfred W. Kozak; Joseph R. Dwyer

[57] ABSTRACT

An ink supply means for a matrix printer with means for replenishing the ribbon ink for increased ribbon life and a ribbon transport combining high-speed reversibility and means for preventing ink depletion and for preventing ribbon destruction at the print head wires; all particularly adapted for a point-of-sale terminal.

5 Claims, 3 Drawing Figures

DATA TERMINAL PRINTING ASSEMBLY

CROSS REFERENCES TO RELATED APPLICATIONS

This is a continuation, of application Ser. No. 327,515, filed Jan. 29, 1973, now abandoned.

U.S. application entitled "Character Strobing in a Data Terminal", of Hartley M. Naas, Julian C. Sutherland and Dale D. Nesbitt, filed Jan. 5, 1973, and which issued as U.S. Pat. No. 3,838,250 with the title "Control For A Matrix Printing Assembly";

U.S. application entitled "A Data Terminal with Dual Three-Station Printing" on Howard R. Cederberg and Charles W. Weideman, filed Jan. 5, 1973, now U.S. Pat. No. 3,825,681;

U.S. application entitled "An Assembly for Spooling an Audit Trail in a Data Terminal" of James G. Savage and Arnold L. Hawkins, filed Jan. 5, 1973, now U.S. Pat. No. 3,834,638.

BACKGROUND OF THE INVENTION

1. Field of Invention

This invention relates, in general, to an improved ribbon inking means for printing by a matrix tape printer and is particularly directed to a means for accommodating a typewriter spool type ribbon with means for replenishing the ink supply for increased ribbon life and transport means having high-speed reversibility and for changing the direction of the ribbon, while not in the print field, thereby preventing ink depletion at the print head wires, which ink depletion would otherwise occur by the dwell of the ribbon before the print head wires. This invention relates, in particular, to utilizing the foregoing in a data terminal, such as a point-of-sale terminal.

2. Description of the Prior Art

Conventional matrix printers have a plurality of wires, each individually moved by a magnetic actuator, usually against a return spring, to impact a record medium to print a character at a time. Such matrix printers use either seven or thirty-five such wires positioned in aligned configuration at the point of impact and individually and sequentially strobed so as to print a character. The strobing of each wire, the positioning of the entire character on the media, and the spacing of the characters to form a printed line can be effected by electronic circuitry, usually timing devices or counters os some type.

Heretofore, it was necessary to use a specially designed and manufactured ribbon to maintain the degree of blackness on the record medium since it is impacted at rather high speeds by the matrix printer wires. The specially designed ribbon made it difficult to service.

Also, ribbon life was short and ribbon wear was high because of the speed of operation of the printer decreasing the functionality and acceptability of matrix printers in the market.

SUMMARY OF THE INVENTION

This invention comprises a means for transporting a typewriter type spool ribbon before the print head wires of a matrix printing assembly for a point-of-sale data terminal, together with a means for replenishing the ribbon both prior to its access to the print head wires and prior to being rewound on the rewind spool. The re-inking step, accomplished by a pair of ink reservoirs and before rewinding, permits the ink migration in the ribbon assuring adequate ink supply before the ribbon is again used by the matrix printer. Means are also provided for automatically and quickly reversing the direction of travel of the ribbon when the ribbon nears the end of the reel but at a time when the printer is not operative to prevent the ribbon from being depleted of ink during operation and to prevent destructive impact to the ribbon which would otherwise occur by the dwell of ribbon under impact of the driven wires of the matrix printer.

DESCRIPTION OF THE PREFERRED EMBODIMENT

Figure 1:
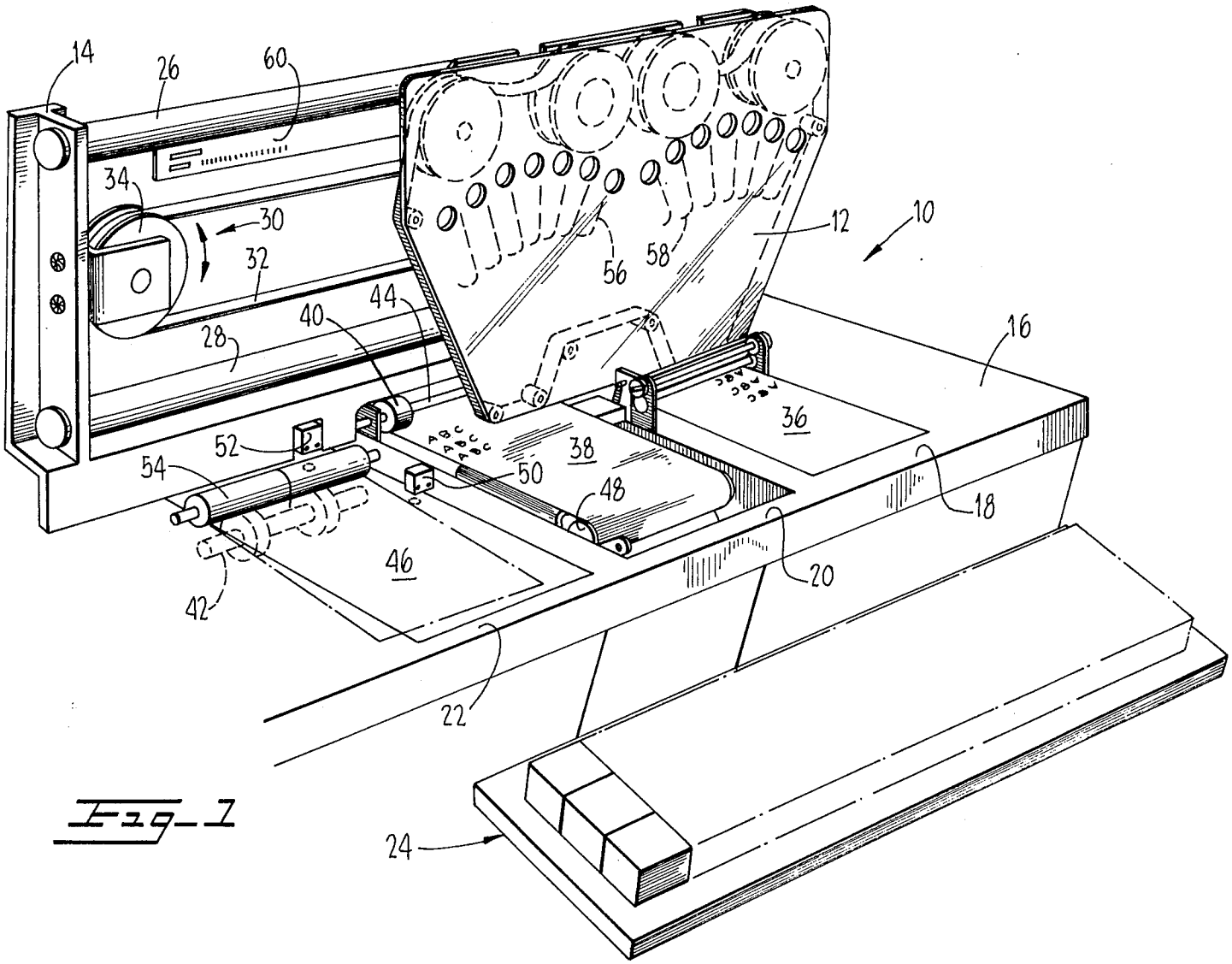
FIG. 1 is a perspective of a cutaway portion of a data terminal schematized to illustrate the carriage for the matrix printers as the carriage travels across the platen for printing on the record media.

In FIG. 1, the data terminal 10 (with cover removed for purposes of clarity) is shown as comprising, overall, a carriage 12 movable laterally with respect to a frame 14, a platen 16 having three print stations 18, 20 and 22, and an appropriate keyboard 24. The three print stations 18, 20 and 22 are, respectively, a receipt station where the customer's receipt is printed (if a receipt is required), an audit station where the storekeeper's record (audit trail) of all tranactions are printed, and a form station where the customer's order form or bill of sale is printed, if required.

By this arrangement, the carriage 12 will move, not only from the printing position shown viz, at the audit station and receipt station, but to the form station and audit station as well as traversing each pairs of stations so that appropriate rows and columns of data entered into the data terminal at the keyboard 24 is appropriately printed out. The carriage 12 is mounted on a pair of bars 26 and 28 to hold the carriage in parallel relationship with the platen 16 and the rest of the data terminal and traverse movement on the parallel bars is accomplished by a suitable drive mechanism 30 including a belt 32 attached to carriage 12 and pulley means 34 motivated by a reversible motor (not shown).

In the embodiment shown, a receipt 36, if required, is printed in the receipt station 18 and an audit trail 38 is printed in the audit station 20 when the carriage 12 is in the position shown as the two record media (paper) are moved forward, i.e., in the direction of the keyboard 24, and forms a suitable supply, such as a roll of paper, by a suitable roller feed mechanism 40 driven by a motor and clutch means 42 coupled to shaft 44. When the carriage 12 is positioned to the left from that shown, a form 46, such as a customer order form or bill of sale, is printed in station 22 at the same time the audit trail 38 is being printed.

The audit trail 38 is rolled onto a spool 48, partially shown in FIG. 1, while the receipt 36 is severed, when a complete transaction is recorded, by a suitable cutting mechanism, indicated in its entirety at 49. Also, the forms station is provided with a pair of electronic sensing means 50 and 52 which determine when a form 46 is properly located in the forms station, otherwise the terminal is inhibited from operating; suitable electronics being provided for this purpose. Rollers 54 feed the form in a direction opposite from the direction of travel of the audit trail by suitable gearing to couple the rollers to shaft 44 which moves the form and audit trail or audit trail and receipt, or audit trail alone, as the case may be, incrementally, in response to and in combination with printing mechanisms to form rows and columns of data as determined by the input to the keyboard 24.

The carriage 12 is also provided with a pair of matrix printers 56 and 58 capable of printing on two of the three stations at the same time, viz, the receipt station and the audit station, or when the carriage is positioned to the left from that shown on the form station and audit station.

Figure 3:
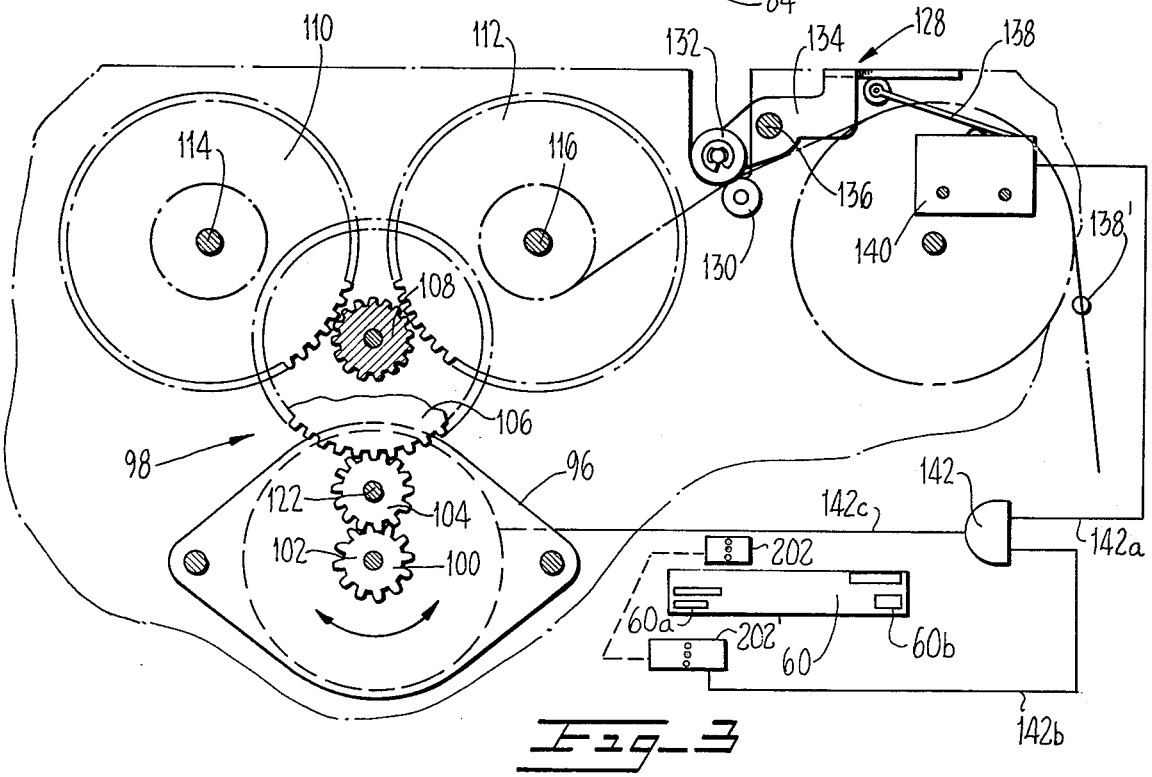
FIG. 3 is a schematized plan view of the transport means.

For the proper positioning of the rows and columns of characters to be printed on the record media, the combination of a strobe bar 60, sensors 202 and 202' which move with the printing carriage, plus cooperating electronics, are shown in FIG. 3 and described hereinafter.

It should be noted at this time, however, that one of the many advantages of matrix printers in the data terminal is the ability to print legibly through several copies of forms in the form station and, also, by suitable electronics described and claimed in the copending application supra, the printing on the receipt is upside down relative to the printing on the audit trail and form. This upside down printing on the receipt enables the complete transaction, such as a sale, to be recorded and totaled in the manner in which any transaction is normally read, i.e., top to bottom for the benefit of the customer. This is also true of the form printed at the form station since the form moves in a direction opposite to the direction of travel of the receipt. This is not true, however, for the printing on the audit trail, which is stored in the machine to be used by the vendor.

Figure 2:
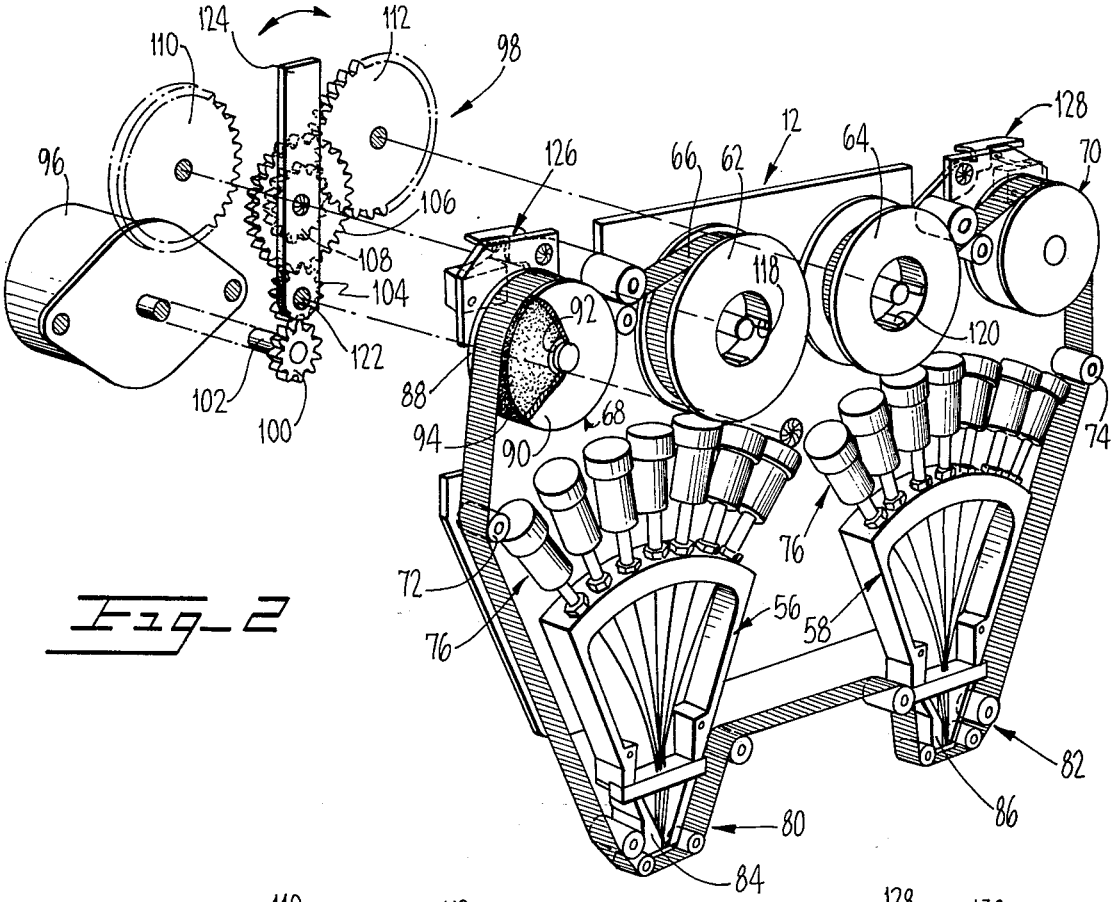
FIG. 2 is an exploded perspective view also schematized of the carriage showing the details of the ribbon ink replenishing means and the ribbon transport means with high-speed reversibility for changing the direction of travel of the ribbon.

Turning now to FIGS. 2 and 3, it can be seen that the carriage 12 comprises, generally, a pair of ink ribbon reels 62 and 64 on which an inking ribbon 66 is wound and unwound, depending upon its direction of travel, a pair of ink reservoirs 68 and 70, and a pair of ribbon guides 72 and 74, respectively, located adjacent the ink reservoirs and positioned to direct the ribbon free of the magnetic actuators 76 of the matrix printers 56 and 58. In the embodiment shown, each matrix printer has four ribbon guides indicated as a group as 80 and 82 with respect to matrix printers 56 and 82 with respect to matrix printer 58, which direct the ribbon past the wire guides 84 and 86 and between the guides and the record media, as more clearly shown in FIG. 1.

Thus, the path of travel of the ribbon, explaining it in one direction as an example, is from reel 64, around reservoir 70, past guide 74, past the wire guide 86 as directed by the ribbon guides 82, past the second wire guide 84, as directed by the ribbon guides 80, around the ribbon guide 72, around reservoir 68 and onto the reel 62. Obviously, the direction of travel is the reverse of that described when the reel 64 becomes the take-up reel.

To supply ink to the ribbon, ink reservoirs 68 and 70 are rotatably mounted on the carriage in the path of travel of the ribbon and are rotated thereby. For the purposes of simplicity in the drawings only, reservoir 68 has been cutaway to show its inner details, it being understood that reservoir 70 is identical. It can be seen that the reservoir comprises a pair of side plates 88 and 90 with a center spool 92 over which a torus 94 of Neoprene sponge-like material is contained, saturated with ribbon ink to supply ink to the ribbon 66 as it passes thereover.

Transportation of the ribbon is accomplished by a reversible motor 96 driving through a gear train 98 which comprises a relatively small gear 100 mounted on the motor shaft 102 which meshes with a second small gear 104 which, in turn, is coupled to a large and small gear combination 106 and 108 which are driven together. Gear 106 meshes with gear 104 and gear 108 meshes with either of a pair of relatively large gears 110 and 112. Gears 110 and 112 are, in turn, each mounted on shafts 114 and 116 to alternately drive the reels 62 and 64 through a pair of reel hedges 118 and 120.

In the embodiment shown, gear 104 is affixed to a shaft 122 which is also a pivot for a bar 124 on which the gear combination 106, 108 is mounted so that the small gear 108 may mesh with either gear 110 or 112, depending upon the direction of the travel of the motor shaft 102. It has been found that the motor, when driven, will maintain the meshing of gear 108 with either of gears 110 or 112 upon the reverse of direction of the motor, the reaction of the gear train will cause the bar 124 to pivot about its shaft, thus throwing the bar in one direction or the other, depending upon the direction of rotation of the motor shaft, thus quickly reversing the direction of travel of the ribbon by quickly changing meshing between gear 100 with either of gears 110 or 112.

To determine when the ink ribbon 66 is near the end of its reel and to prevent unraveling of the ribbon off the spool, by reversing its direction, i.e., to activate and change the direction of rotation of the reversible motor 96, a pair of sensing devices 126 and 128 are located near the reels but shown in the drawings as between the spools and the reservoirs. Activation of these sensing devices (in addition to activation of the light sensor unit 202, 202') will cause a reversal of direction of rotation of the motor 96, thus changing direction of travel of the ribbon.

To simplify the description, only one of the sensing means will be described in detail, it being understood that the other sensing means is identical but simply the reverse thereof because of the side of the reel with which it operates.

Turning now specifically to FIG. 3, it can be seen that the sensing device 128 comprises a pair of ribbon guides 130 and 132; guide 130 being rotatably mounted on a shaft affixed to the carriage, while the guide 132 is rotatably mounted on an arm 134 which pivots about a pin 136. During operation, the ribbon 66 passes between the two guides 130, 132 and the ribbon is provided with an actuator 138 trigger-button 138' which, when passing between the two guides, pivots the arm 134. This pivot motion causes the other end of the arm 134 to, in turn, move the actuator arm 138 of a snap action switch 140. Snap action switch 140 is connected to the motor 96 through an AND-gate 142 which also is operatively connected to the light sensor 202' on line $142_b$. A light-emitting diode unit 202 is connected to light sensor 202' so that both units move with the print carriage along the length of the strobe bar 60. The trigger-button (or actuator button) 138' is placed at a considerable distance from the tailend of the ribbon, so that a considerable time period occurs between the actuation of the switch 140 and the appearance of the tail-end of the ribbon 66. This length of ribbon, which represents a period of time, is set for a "worst case" situation wherein the printer carriage will reach the "no-print position" long before the tail-end of the ribbon is reached. Thus, there is sufficient ribbon remaining (after trigger-button 138' actuates lever 138 and switch 140) that the print carriage will reacn a "no-print position" long before the tail-end of the ribbon could unravel from the spool.

Because of this safety factor, there is always sufficient remaining ribbon around the spool to permit the motor 96 to reverse direction of the ribbon long before there is any possibility of the tail-end of the ribbon unraveling from the spool 62 or 64.

Sensing devices, 202 and 202', carried by the carriage 12 in which function with the strobe bar 60 will indicate that the matrix print heads are in a position on either side of the record media and it is at this time the output of the AND-gate 142 will provide a signal to cause the reversal of the motor 96, since the input lines $\mathbf{142}_a$ and $\mathbf{142}_b$ will both be activated. Motor 96 is a typical permanent magnet synchronous motor having three terminals, a common terminal and two directional terminals. The input power lines connect to the common and one or other of the directional terminals to control rotational direction of the motor. An input power switch is used to regulate motor direction. For purposes of this disclosure, since it is more fully described in U.S. Pat. No. 3,838,250 entitled "Control For A Matrix Printing Assembly," supra, it should be noted that the strobe bar 60 contains a plurality of slots called "home slots" (60*a* and 60*b* – FIG. 3) which are precisely located relative to the carriage by being permanently affixed to the frame 14. Sensing devices (202 and 202') carried by the carriage, when positioned so as to signal the location of the carriage by the uncovering of the home slots, indicate to the electronics, that the carriage is in a non-printing position.

The AND-gate 142 requires that two conditions must be met before the motor 96 will be given the signal to reverse itself via output line $\mathbf{142}_c$. These two conditions are that:

a. The strobe bar sensor gives a signal output (to AND-gate 142) that the printing heads are in a non-printout position; and b. The sensing device 128 together with its actuator 138 and switch 140 provide a signal indicating that the ribbon 66 is nearly at the end of its length on the reel 64 (or the reel 62 as the case may be).

Thus, with the use of the AND-gate to insure that there will be no stopping or reversing of the ribbon until the carriage and printheads are in a no-print area, Applicants have eliminated the problem of "dwell", that is to say, the condition wherein the printing ribbon is stationary or still and the print wires are impacting the ribbon at the rate of many thousands of times per second which could result in the rapid destruction of the ribbon. Thus, the major idea here is to keep the ribbon moving rapidly as long as printing is taking place by the impact of the wire styli, but to insure that the ribbon motion will only be stopped or reversed during a period when the carriage and printhead are in a no-print area or location. Thus, there is insured a condition where there will be no destructive impact upon a still or "reversing" ribbon which has been stopped and/or is changing direction. Thus, the destruction of the ribbon is prevented at the same time that the other elements of the combination structure are providing for a thorough ink replenishment of the ribbon so that the printout, when it occurs, will be clean and clear.

What is claimed is:

1. A matrix printer on a movable carriage, said printer having a plurality of wires for impacting through a ribbon to a record medium to print a character thereon comprising:

means for supplying ink for printing via said ribbon as the wires impact the record medium, said means including an ink ribbon, a first and second reel and ink replenishment means contacting said ribbon for ink replenishment;

means for transporting said ribbon past said wires at their point of impact by winding said ribbon off one of said reels and onto the other;

triggering means attached to said ribbon and located a predetermined distance from each tail-end of said ribbon, said predetermined distance being sufficiently long to insure that said tail-end of said ribbon cannot be unraveled from said reel before the ribbon direction is reversed;

means for sensing the approach of the end-portion of said ribbon as said ribbon unwinds from one reel, said means including said triggering means and a switch activated by said triggering means;

means for sensing when the printer is located in a non-printout location, said means including a stationary strobe bar aligned with said record medium and sensors which move with said movable carriage;

means for reversing the direction of travel of the said ribbon, said means including:

an AND-gate having a first input from said switch, a second input from said printer carriage sensors, and having an output line;

motor drive means to drive said first and second reel, wherein a signal from said AND-gate output line initiates a direction-reversal of said motor drive means.

2. The matrix printer as claimed in claim 1 wherein the means for supplying ink includes means to ink the ribbon so as to allow ink migration on the ribbon while said ribbon is wound on one of said reels and including an ink supply reservoir which is accessed as the ribbon is wound off one reel but before traveling past the point of impact of the wires, and a second reservoir which is accessed by said ribbon before being wound on the second reel after traveling past the point of impact of the wires.

3. A data terminal having a pair of matrix printers each having a plurality of wires for impacting ribbon ink onto a record media to print a character thereon at the point of impact, comprising:

a strobe bar;

a carrier having said printers disposed therein;

means in said carrier for supplying ink for printing as the wires impact the record medium including:

a. an ink ribbon, and a first and second reel, b. means for transporting said ribbon past said wires at their point of impact by winding said ribbon off one reel and onto another, c. means for inking said ribbon as it is being transported;

carrier position sensing means working in cooperation with said strobe bar to provide signals indicative of whether said carriage and printheads are in a location permissible for printout or are in a non-printout position;

means for sensing the approach of the end of the ribbon as it unwinds from one reel of either said first or said second reel;

means for reversing the direction of travel of the ribbon said means including:

motor drive means connected to drive said ribbon in a given direction, an AND-gate having two inputs and one output, said inputs being derived from said carrier position sensing means and from said means for sensing the approach of the ribbon end, power input switch means connected to said motor drive means for reversing the direction of rotation of said motor drive means, said power input switch means being activated upon receipt of an output signal from said AND-gate.

4. The data terminal as claimed in claim 3 wherein the means for inking the ribbon as it is being transported includes means to ink the ribbon so as to allow ink migration on the ribbon while on one of said reels and including an ink supply reservoir which is accessed as the ribbon is wound off one reel but before traveling past the point of impact of the wires, and a second reservoir which is accessed by said ribbon before being wound on the second reel after traveling past the point of impact of the wires.

5. The data terminal of claim 3 wherein said means for sensing the approach of the end of the ribbon as it unwinds from a reel includes:

a. an actuator which maintains a contact with said ribbon, and b. switching means responsive to the position of said actuator, wherein said actuator and switching means operate so as to provide a signal when said ribbon on said reel approaches the end of its length and wherein said actuator is set to actuate said switching means and said means for reversing direction of the ribbon well before there is any possibility of the unraveling of the ribbon from its spool.

* * * * *